US007866331B2

(12) United States Patent
Glatz

(10) Patent No.: US 7,866,331 B2
(45) Date of Patent: Jan. 11, 2011

(54) FREE-ARM CANOPY

(75) Inventor: Gustav Adolf Glatz, Frauenfeld (CH)

(73) Assignee: Glatz AG, Frauenfeld (CH)

( * ) Notice: Subject to any disclaimer, the term of this patent is extended or adjusted under 35 U.S.C. 154(b) by 140 days.

(21) Appl. No.: 11/991,280

(22) PCT Filed: Sep. 12, 2006

(86) PCT No.: PCT/CH2006/000490

§ 371 (c)(1),
(2), (4) Date: Feb. 29, 2008

(87) PCT Pub. No.: WO2007/045106

PCT Pub. Date: Apr. 26, 2007

(65) Prior Publication Data

US 2009/0151759 A1 Jun. 18, 2009

(30) Foreign Application Priority Data

Oct. 18, 2005 (CH) ..... 1680/05

(51) Int. Cl.
*A45B 23/00* (2006.01)

(52) U.S. Cl. ..... 135/21

(58) Field of Classification Search ..... 135/21, 135/98, 20.3, 20.1
See application file for complete search history.

(56) References Cited

U.S. PATENT DOCUMENTS 200,945 A * 3/1878 Smith ..... 135/21
2,984,249 A * 5/1961 Sears, Jr. et al. ..... 135/21
4,586,525 A 5/1986 Glatz et al.
5,116,258 A * 5/1992 Vennik ..... 135/20.3
6,014,980 A 1/2000 Glatz
6,152,156 A * 11/2000 Tung ..... 135/21
6,478,037 B2 * 11/2002 Tung ..... 135/21

(Continued)

FOREIGN PATENT DOCUMENTS

DE 33 39 163 A1 3/1985

(Continued)

*Primary Examiner*—David Dunn
*Assistant Examiner*—Noah Chandler Hawk
(74) *Attorney, Agent, or Firm*—George Pappas

(57) ABSTRACT

The free-arm canopy comprises a mast (2), on which an extendable and retractable jib (10) is arranged, with a transverse fitting (34) at the end thereof on which a canopy (12) is arranged on a canopy pole (30) by means of a joint (32). The canopy (12) comprises a slider (36), connected in a jointed fashion to top ribs (44) by means of support ribs (40) which are further jointed to a crown (48) connected to the canopy pole (30), wherein the canopy (12) may be opened and closed by means of a tensile line (70) connected to the slider (36) and displacing the canopy pole (30) against the fitting (34) and thus locking the joint (32) on opening. According to the invention, the free-arm canopy may be improved, whereby the crown (48) of the canopy (12) is arranged on the upper end of a pole piece (52) in the form of a sleeve which may be displaced over the fitting (34) such that with an open canopy (12) the crown (48) goes over the joint (32) and is at least almost in contact with the jib (10).

8 Claims, 5 Drawing Sheets

U.S. PATENT DOCUMENTS

| | | | | |
|---|---|---|---|---|
| 6,662,815 | B2 * | 12/2003 | Tung | 135/20.1 |
| 7,156,114 | B2 * | 1/2007 | Lo | 135/21 |
| 2003/0019511 | A1 * | 1/2003 | Liu | 135/20.1 |
| 2003/0192580 | A1 | 10/2003 | Tung | |
| 2005/0268952 | A1 | 12/2005 | Joen-an Ma | |

FOREIGN PATENT DOCUMENTS

| | | | |
|---|---|---|---|
| DE | 200 15 974 | U1 | 12/2000 |
| EP | 1 550 383 | A1 | 7/2005 |

* cited by examiner

FREE-ARM CANOPY

The application claims priority of PCT application PCT/CH2006/000490 having a priority date of Oct. 18, 2005, the disclosure of which is incorporated herein by reference.

Technical Field

The invention relates to a cantilever parasol.

Background of the Invention

A cantilever parasol of the type mentioned at the outset is known for example from EP 1 550 383 A. The cantilever parasol has a mast on which a retractable and extendable arm is arranged. At the free end of the arm there is an attachment, projecting transversely thereto, on which a parasol is arranged by means of a parasol stick and via an articulation means. The parasol has a sliding part that is connected to canopy ribs in articulated manner via support rods, and these canopy ribs are in turn articulated to a crown that is connected to the parasol stick. The parasol stick has an upper insertion part, by means of which it engages in a receiving part of the attachment when the parasol is open and hence locks the articulation means. It is disadvantageous that, as a result of the construction, the crown of the parasol is relatively far away from the arm when the parasol is open, as a result of which the center of gravity of the open parasol is correspondingly far away from the arm, which makes it difficult to position the open parasol obliquely by pivoting the arm about its axis, and prevents a compact design.

Furthermore, US2003/0192580 A discloses a further cantilever parasol, in which an attachment is arranged at the free end of the arm, projecting transversely thereto. The attachment has at the lower end an articulation shell with an internal toothing that cooperates with an articulation head that has an external toothing and is mounted at the upper end of the parasol stick. The crown of the parasol is arranged before the articulation head, at the upper end of the parasol stick. The arrangement is not only very complex but also has the effect of the parasol being relatively far away from the arm. The articulation means is freely accessible and unprotected at all times. The parasol is opened by means of a cable, by raising the sliding part, with the toothing also being engaged at the same time to fix the position of the parasol. It is disadvantageous that even a slight lessening of the cable tension results in loosening or even detachment of the latching of the toothing, which can result not only in damage to the toothing but in particular also in undesirable pivoting of the parasol on the arm and hence a risk of accident.

U.S. Pat. No. 6,014,980 discloses a further cantilever parasol in which there is arranged at the free end of the arm, by means of an articulation means, an attachment to which the parasol stick is fixed, the crown being connected to a bar that keeps the open parasol at an angle to the arm. Here too, the crown is relatively far away from the arm and the articulation means is unprotected at all times, thus resulting in the disadvantages already discussed above.

SUMMARY OF THE INVENTION

The object of the invention is to improve the cantilever parasol of the type mentioned at the outset.

Because the crown of the parasol is arranged at the upper end region of a sleeve-shaped stick part that is slidable over the attachment such that the crown rises above the articulation means when the parasol is opened and is at least approximately adjacent to the arm, the distance between the center of gravity of the open parasol and the arm is reduced, as a result of which less force has to be applied to position the open parasol obliquely by pivoting the arm. Moreover, this construction makes it possible to reduce the overall required height of the cantilever parasol. Because the crown rises above the articulation means in the open condition of the parasol, the articulation means is not only protected in optimum manner but the parasol is locked in the set position in a manner that remains secure even if the cable tension lessens.

Furthermore, when the parasol is open the articulation means disappears inside the parasol so that it is completely invisible and is thus protected from soiling and reduces the risk of injury to the user. Because of this, and because the parasol is less far away from the arm, the appearance of the cantilever parasol is improved.

The crown may have an upper collar in which there is arranged an articulated pin that is guided in an elongate slot in the attachment, with the collar having, on a side that is parallel to the articulated pin, a cutout that corresponds approximately to half the cross section of the attachment such that the crown is pivotal in relation to the attachment when the parasol is closed. This results in a very simple type of construction in which the articulated part is protected, with the result that the risk of being pinched is avoided. The disadvantage here is that the cutout is on the collar of the crown.

An embodiment which is more advantageous, is where the parasol stick has, on the upper part, a stick part that is displaceable in the sleeve-like stick part and that is connected via the articulation means to the attachment, with a groove that delimits the slide travel being provided in the attachment and in the adjoining stick part, with a sliding block that is arranged inside the sleeve-like stick part or crown engaging in this groove. In this case, there is no need for a cutout in a collar, and the crown has a solid outline. Moreover, the sleeve-like stick part is guided on either side of the articulation means by the groove/sliding block arrangement, in a manner preventing detachment.

The attachment may be nondetachably connected to the arm. Advantageously, however, the cantilever parasol is constructed such that the attachment may be removed from the arm.

BRIEF DESCRIPTION OF THE DRAWINGS

Exemplary embodiments of the cantilever parasol are described below in more detail and with reference to the drawings, in which.

DETAILED DESCRIPTION OF THE PREFERRED EMBODIMENT

Figure 1:
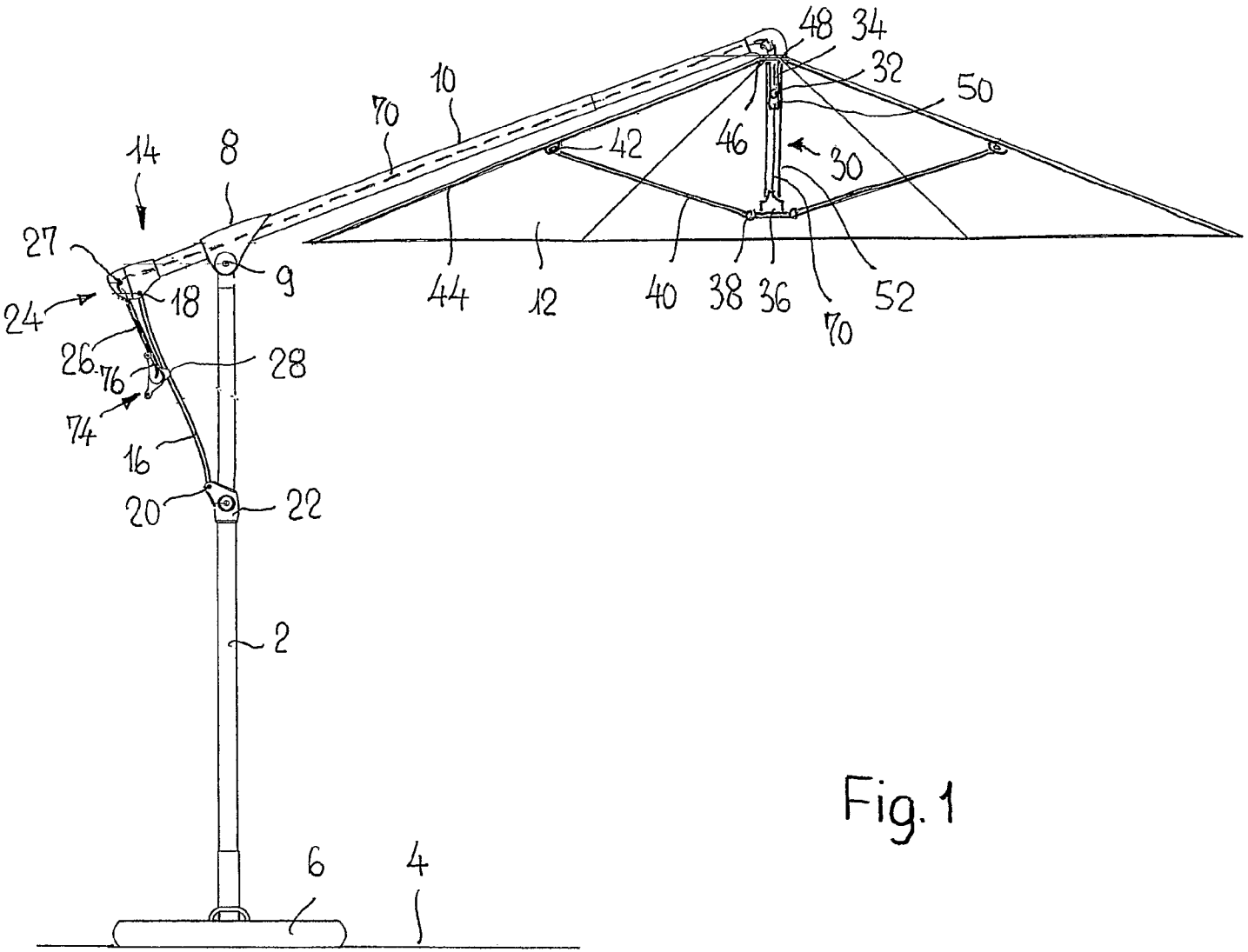
FIG. 1 shows a cantilever parasol in the open condition, in side view and with the parasol in vertical section.
Figure 2:
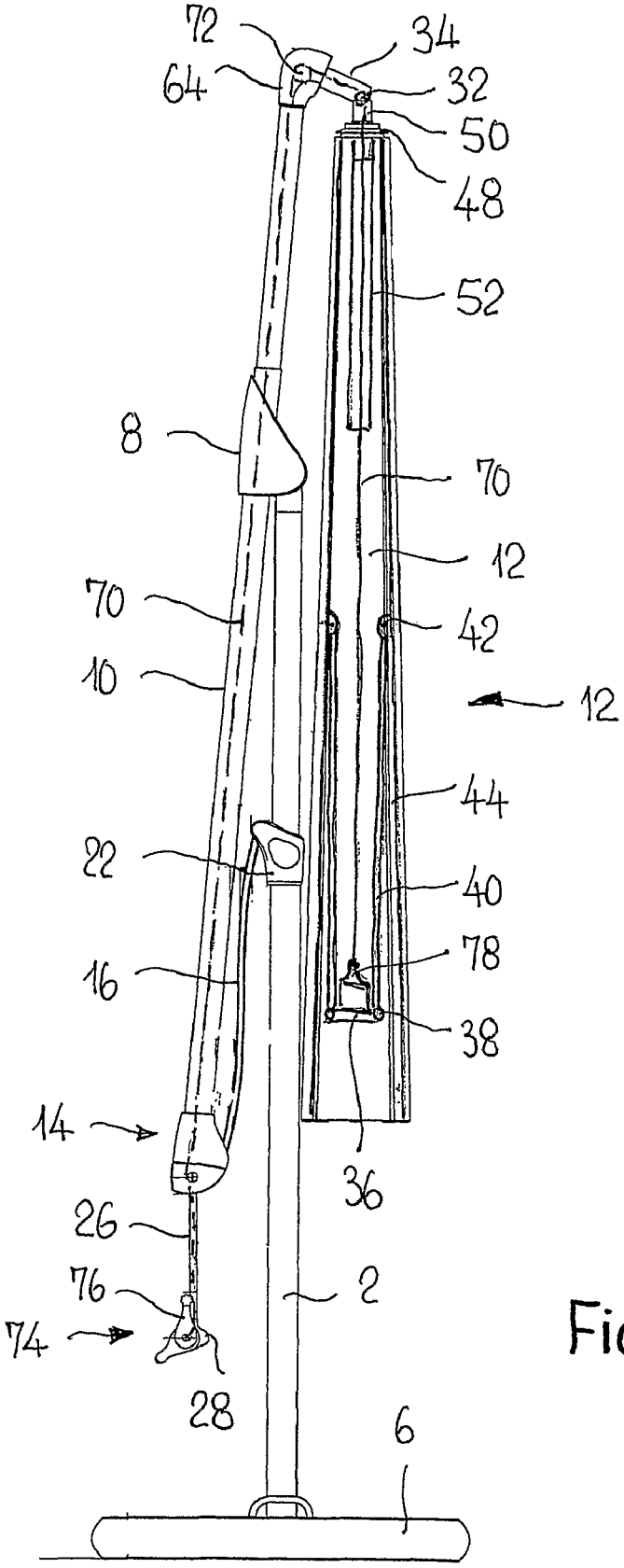
FIG. 2 shows the cantilever parasol from FIG. 1, in the closed condition.

FIG. 1 shows a cantilever parasol in its extended position, with the parasol open, and FIG. 2 shows this cantilever parasol in the closed, folded-up position. The cantilever parasol has a mast 2, which may be anchored in the ground 4 or in a base 6. At the upper end of the mast 2, on a sliding bearing 8, an arm 10 is mounted such that it may be extended and retracted in its longitudinal direction and such that it may pivot about its axis. The sliding bearing 8 is arranged on the mast 2 such that it may pivot by way of an articulation means 9. At one end the arm carries a parasol 12 and at the other end the arm 10 is borne in a bearing 14 such that it may pivot about its axis. The bearing 14 is supported against the mast 2 by way of a carrier element 16. To this end, the carrier element 16 is secured to the bearing 14 by way of an articulation means 18 and to a carrier sleeve 22, which is arranged on the mast 2, by way of an articulation means 20. There is a locking device 24 (not illustrated in greater detail) on the bearing 14, for locking the pivot position of the arm 10 in a selectable pivot position. To this end, the locking device is fitted with a control rod 26 that is aligned such that it forms an extension to the arm 10 and that may be angled in relation to the carrier element 16 by way of an articulation means 27. The control rod may be latched to the carrier element 16 by means of a latching device 28. In the unlatched condition, the control rod 26 may be pivoted about the axis of the arm and may be detachably coupled to the arm by means of a coupling device (which is not illustrated in greater detail) at selectable angles of rotation in relation to the arm, so that in the open condition the parasol can be positioned obliquely and locked in this position.

Figure 3:
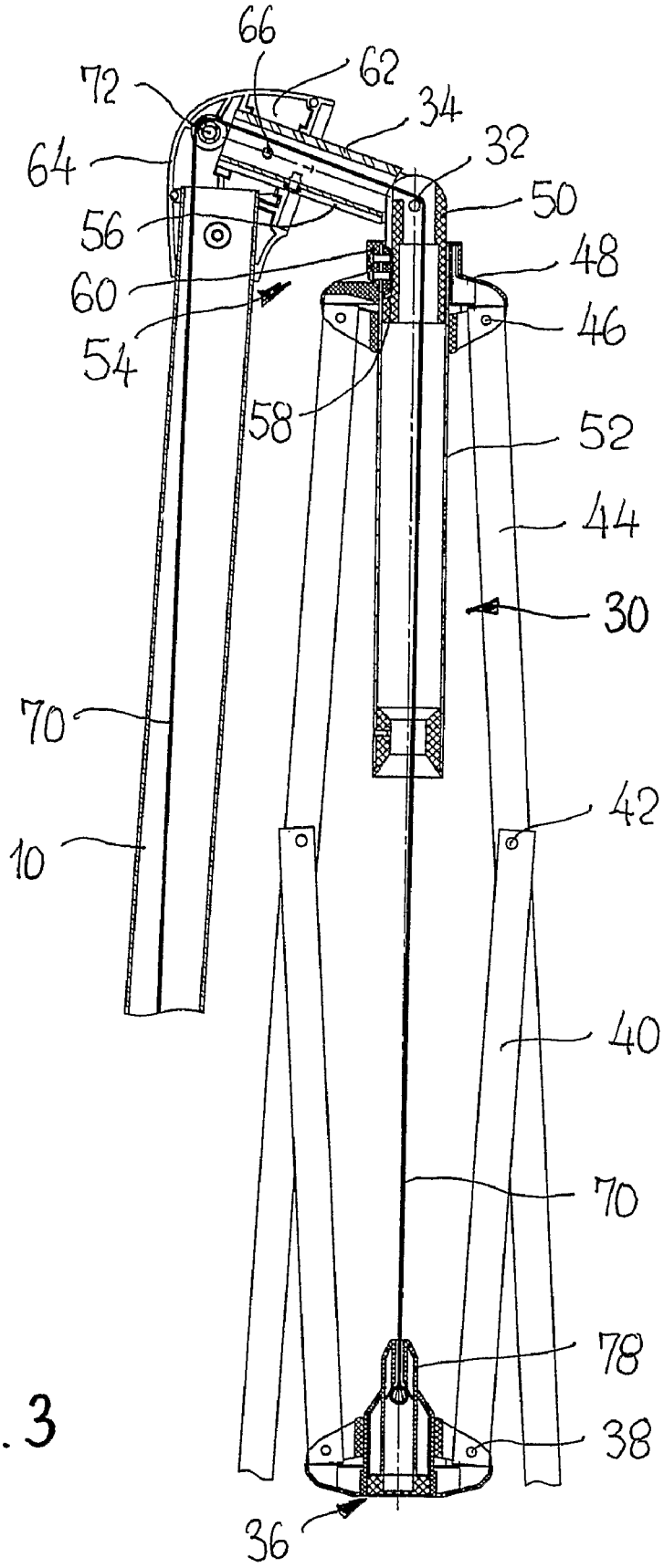
FIG. 3 shows the parasol stick and the suspension region of the cantilever parasol from FIGS. 1 and 2, in the closed condition, on a larger scale and in vertical section.
Figure 4:
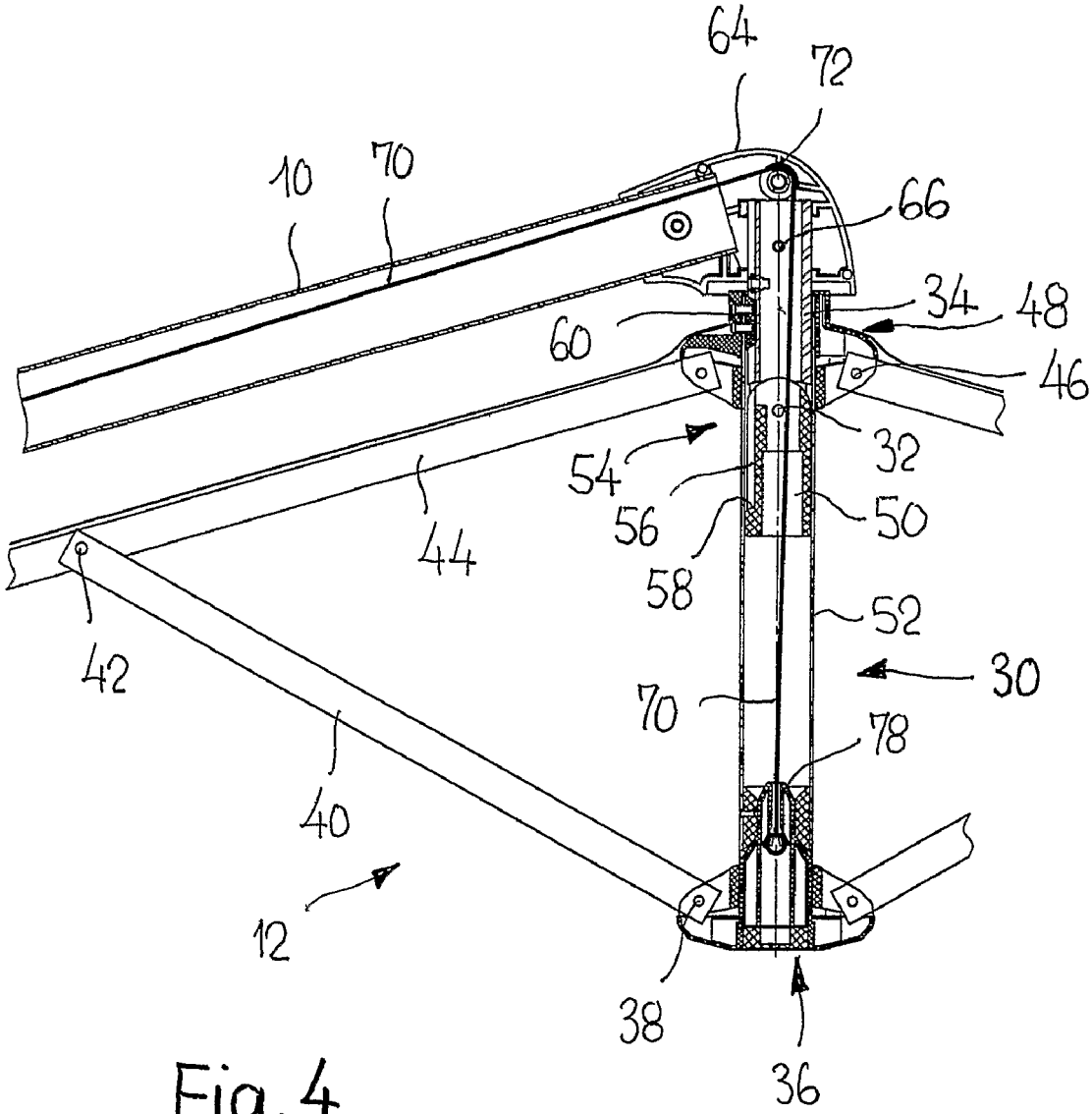
FIG. 4 shows the parasol stick and the suspension region from FIG. 3, in the open condition.

As can be seen from FIGS. 1 and 2, and in particular from FIGS. 3 and 4, the parasol 12 is arranged on an attachment 34 by means of a parasol stick 30 and via an articulation means 32, this attachment 34 being arranged at the free end of the arm 10 and projecting transversely thereto. The parasol includes a sliding part 36 to which support rods 40 are connected via articulation means 38, and these support rods 40 are in turn connected to canopy ribs 44 via articulation means 42. These canopy ribs are in turn connected, via articulation means 46, to a crown 48 that is secured to the parasol stick 30. The parasol stick 30 is formed by a stick part 50, which is connected to the attachment 34 via the articulation point 32. Furthermore, the parasol stick 30 includes a sleeve-shaped stick part 52, which is arranged over the stick part 50 and at the upper end of which the crown 48 is secured. The attachment 34 is in this case constructed such that it forms a prolongation of the stick part 50 and the crown 48 may be moved in relation to the arm 10 by means of the sleeve-like stick part 52, with the result that the crown 48 rises above the pivot point of the articulation means 32 when the parasol 12 is opened and lies adjacent to the arm 10. The parasol stick 30 is fitted with a means 54 to prevent detachment, which comprises a groove 56 that runs in the attachment 34 and the stick part 50 as far as a stop 58. Arranged on the inside of the sleeve-like stick part 52 is a sliding block 60, which may be moved in the groove 56 and whereof the slide travel downward is delimited by the stop 58. The attachment 34 is detachably inserted in a cutout 62 in a head part 64 of the arm 10, and is secured in the head part 64 by means of a pin 66.

A tensor member 70 serves to open and close the parasol, and this is secured to the sliding part 36 and runs through the parasol stick 30 and the attachment 34 into the head part 64 of the arm 10. The tensor member 70 is fed into the arm 10 at a deflection point 72 and runs to the other end of the arm, is deflected further into the control rod 26 and finally arrives at a winder 74, which may be operated by means of a crank 76. To open the parasol, the tensor member 70 is reeled in using the winder 74 until the sliding part 36 engages with a peg 78 in the sleeve-like stick part 52. If the tensor member 70 is reeled in further, the sleeve-like stick part 52 is raised and slides over the attachment 34 until the crown 48 lies adjacent to the arm 10 or its head part 64, as can be seen from FIG. 4. When this happens, the sleeve-like stick part 52 covers the articulation means 32 and so locks the articulation means. The groove/sliding block arrangement ensures that there is also a relatively long safety travel for locking the articulation means, with the result that even if the tension of the tensor member 70 is lessened by a certain amount, or if there is insufficient tension of the parasol when it is opened, the articulation means remains locked and so undesirable swinging of the parasol against the mast is prevented.

Figure 5:
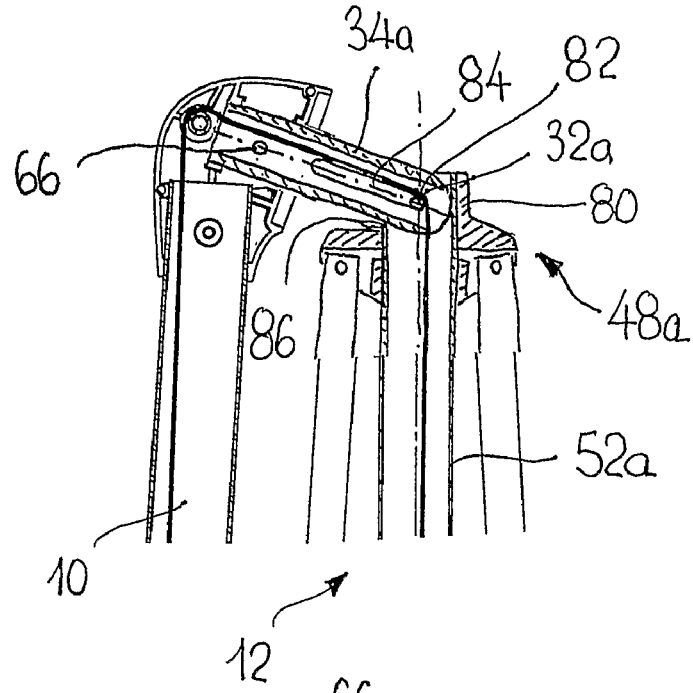
FIG. 5 shows the suspension region from FIG. 3, with a modified suspension.
Figure 6:
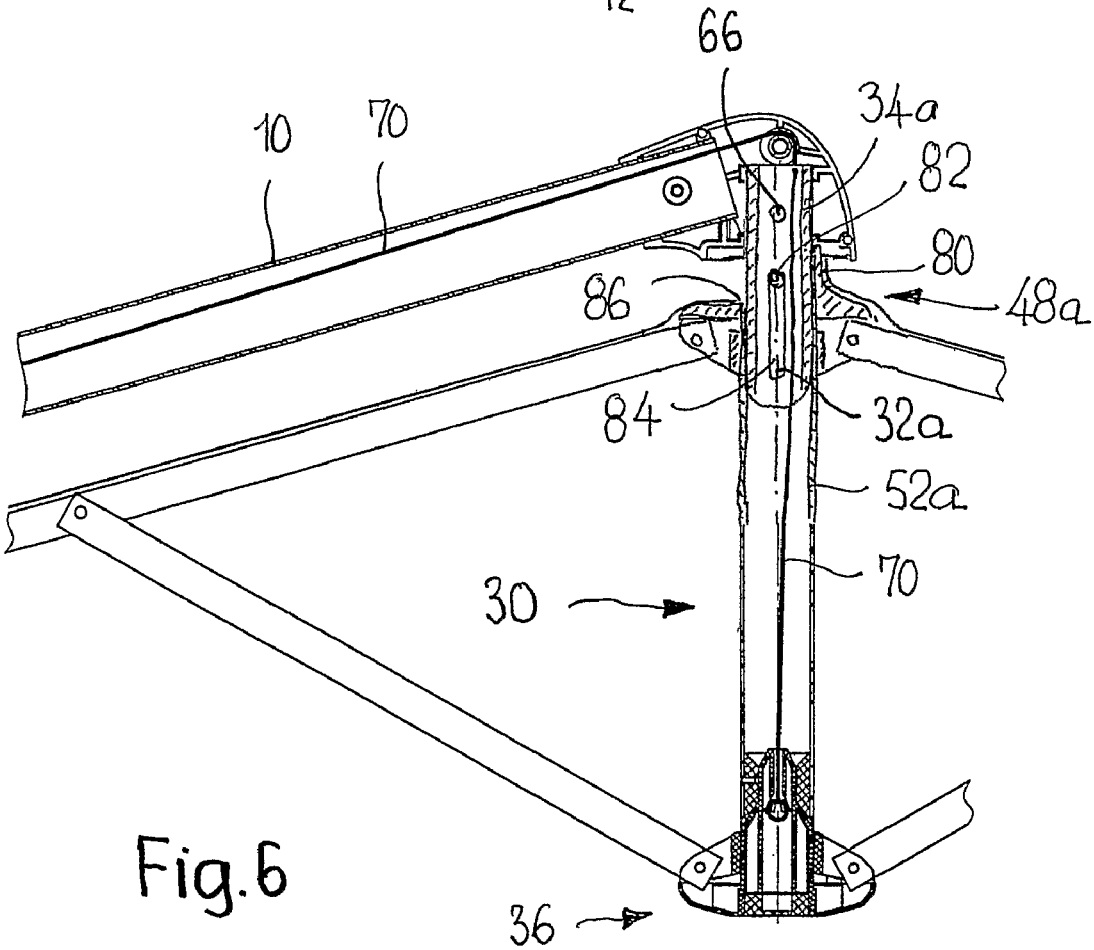
FIG. 6 shows the suspension region from FIG. 5, with the parasol open.

FIGS. 5 and 6 show a modified embodiment of the attachment 34*a* of the articulation means 32*a* and the crown 48*a*. The sleeve-like stick part 52*a* is once again able to move over the attachment 34*a*. The crown 48*a* includes an upper collar 80 in which an articulation pin 82 of the articulation means 32*a* is arranged. The articulation pin 82 is mounted such that it can slide in an elongate slot 84 in the attachment 34*a*. In the bottom position, the articulation means 32*a* is free and the crown 48*a* can pivot about the articulation pin 82. To this end, the collar 80 and the sleeve-like stick part 52*a* have, parallel to the articulation pin 82, a cutout 86 that corresponds approximately to half the cross section of the attachment 34, with the result that in the closed position the parasol can be pivoted in relation to the arm 10, as can be seen from FIG. 5. When the parasol is open, the attachment 34*a* engages in the sleeve-like stick part 52*a* and the articulation pin 82 is at the upper end of the elongate slot 84. The sleeve-like stick part 52*a*, which is arranged over the attachment 34*a*, thus locks the articulation means 32*a*.

The elongate slot 84 also ensures that there is a relatively long slide displacement of the sleeve-like stick part 52*a* and thus also of the crown 48*a*, which carries the articulation pin 82, with the result that here too the articulation means 32*a* remains locked even if there is a slight lessening of the tension of the tensor member 70, and in this way undesirable swinging against the mast is prevented.

LIST OF REFERENCE NUMERALS

2 Mast
4 Ground
6 Base
8 Sliding bearing
9 Articulation means for 8
10 Arm
12 Parasol
14 Bearing
16 Carrier element
18 Articulation means for 14
20 Articulation means for 2
22 Carrier sleeve
24 Locking device
26 Control rod
27 Articulation means for 26
28 Latching device
30 Parasol stick
32, 32*a* Articulation means
34, 34*a* Attachment
36 Sliding part
38 Articulation means
40 Support rod
42 Articulation means
44 Canopy rib
46 Articulation means
48, 48*a* Crown
50 Stick part

52, 52*a* Sleeve-like stick part
54 Means to prevent detachment
56 Groove
58 Stop
60 Sliding block
62 Cutout
64 Head part
66 Pin
70 Tensor member
72 Deflection point
74 Winder
76 Crank
78 Peg
80 Collar
82 Articulation pin
84 Elongate slot
86 Cutout

The invention claimed is:

1. A cantilever parasol assembly, having a mast on which a retractable and extendable arm is arranged, this arm having at its free end an attachment, projecting transversely thereto, on which a parasol is arranged by means of a parasol stick and via an articulation means, the parasol having a sliding part that is connected to canopy ribs in articulated manner via support rods, and these canopy ribs are in turn articulated to a crown that is connected to the parasol stick, it being possible to open and close the parasol by a tensor member, which acts on the sliding part, with the sliding part sliding the parasol stick in relation to the attachment when it is opened and hence locking the articulation means, characterized in that the crown of the parasol is arranged at the upper end region of a sleeve-shaped stick part that is slidable over the attachment such that the crown rises above the articulation means when the parasol is opened and is at least approximately adjacent to the arm and wherein, during the opening of the parasol, the sliding part is engaged with a lower end of the sleeve-shaped stick part and the sliding part and sleeve-shaped stick part are raised together without relative movement therebetween as the sleeve-shaped stick part is slid over the attachment.

2. The cantilever parasol assembly as claimed in claim 1, characterized in that the crown has an upper collar in which there is arranged an articulated pin that is guided in an elongate slot in the attachment, with the collar having, on a side that is parallel to the articulated pin, a cutout that corresponds approximately to half the cross section of the attachment such that the crown is pivotal in relation to the attachment when the parasol is closed.

3. The cantilever parasol assembly as claimed in claim 2, characterized in that the attachment is constructed such that it may be removed from the arm.

4. The cantilever parasol assembly as claimed in claim 1, characterized in that the parasol stick has, on the upper part, a stick part that is displaceable in the sleeve-like stick part and that is connected via the articulation means to the attachment, with a groove that delimits the slide travel being provided in the attachment and in the adjoining stick part, with a sliding block that is arranged inside the sleeve-like stick part or crown engaging in the groove.

5. The cantilever parasol asssembly as claimed in claim 4, characterized in that the attachment is constructed such that it may be removed from the arm.

6. The cantilever parasol assembly as claimed in claim 1, characterized in that the attachment is constructed such that it may be removed from the arm.

7. The cantilever parasol assembly of claim 1 wherein the arm defines an axis and the attachment and the parasol supported thereon are rotatable together with the arm about the axis.

8. The cantilever parasol assembly of claim 1 wherein the tensor member extends from the sliding part through both the sleeve-shaped stick part and the attachment to the arm.

* * * * *